US005823913A

United States Patent [19]

Aruin et al.

[11] Patent Number: 5,823,913

[45] Date of Patent: Oct. 20, 1998

[54] METHOD FOR EXERCISING THE ABDOMINAL MUSCLES

[76] Inventors: Alexander S. Aruin, 1141 B. W. Aaron Dr., State College, Pa. 16803; Leonid M. Raitsin, 91 Vernadsky Str, Building 2, # 110, Moscow, Russian Federation, 117526

[21] Appl. No.: 774,974

[22] Filed: Dec. 26, 1996

[51] Int. Cl.[6] ..... A63B 23/02

[52] U.S. Cl. ..... 482/4; 482/1; 482/148; 482/909; 601/71; 601/79; 340/573; 128/96.1

[58] Field of Search ..... 601/23, 46–49, 601/71, 79, 84; 340/573, 668, 665, 539; 128/782, 96.1, 716, 721; 482/4, 148, 909, 1

[56] References Cited

U.S. PATENT DOCUMENTS 3,642,276 2/1972 Kropf ..... 482/1
4,300,129 11/1981 Cataldo ..... 340/539
4,392,126 7/1983 Loyola ..... 340/573
4,938,476 7/1990 Brunelle et al. ..... 482/148

*Primary Examiner*—Richard J. Apley
*Assistant Examiner*—Glenn E. Richman

[57] ABSTRACT

A device for exercising the abdominal muscles and method comprising an informing unit having a sensor, an announciator with a signal-controlling circuit board and a signal reproducer, and elements to enable positioning and retaining the informing unit on the user's belly. The abdominal muscles are exercised by flexing them using the information from the sensor. These attract the user's attention to the exercising of abdominal muscles, by reproducing an exercise command or musical note, serving to indicate to the user to contract muscles, and stop the command, therefore resulting in more efficient development of the abdominal muscles.

6 Claims, 7 Drawing Sheets

METHOD FOR EXERCISING THE ABDOMINAL MUSCLES

BACKGROUND OF THE INVENTION

This invention relates to equipment for general exercise and/or physical therapy. More specifically it relates to a portable device that is placed around the user's waist and which helps to concentrate the user's attention on exercising of abdominal muscles, therefore resulting in more efficient development of the abdominal muscles.

BRIEF SUMMARY OF THE INVENTION

A bearing (posture) plays significant role in health of any person. Slight activity of stomach and spine muscles make a bearing worse, and promote round-shouldered, defective lordosis, but providing the desired flat stomach. A flat stomach is not only aesthetically pleasing but also indicates that an individual has the abdominal strength necessary to prevent some types of low back pain. Besides that a weak stomach may cause pulmonary ventilation deficiency.

One of the ways to correct posture, prevent future aggravation, and to improve pulmonary ventilation, is to exercise stomach and spine muscles. The process of stretching these muscles requires a lot of effort and may need to continue for a long period of time. What is the most important, and probably the most difficult, is the permanent attention and concentration needed when exercising these particular muscles. The special exercises should be continued during different kinds of activity such as walking, running, and certainly, while quietly sitting and standing.

The sit-up is the most popular exercise used in efforts to flatten the abdomen. However, not all the users like it because of the necessity to lie during exercising. Strong motivation and self-control are other limitations of a sit-up exercise program.

Another type of exercise device requires attachment of it to the body by a belt, and exercising by tightening the abdominal muscles. This pushes against a spring or a weight. However, such devices also require lying during exercising. In addition, a deficiency of time often stops the continuation of exercising of abdominal muscles.

It is the basic objective of the present invention to provide an apparatus for use in exercising the abdominal muscles, in everyday activity without necessity of interrupting for special training.

The present invention provides a specially designed device to be worn around the user's waist. The device provides audio, tactile, or visual signals if the contraction of the user's abdominal muscles is different from expected. This helps to attract the user's attention and requires the user to exercise abdominal muscles to the avoid audio, visual, or tactile effects. Between the strengthening trials the device may provide massage of abdominal muscles.

A number of devices attached to the body by a belt have been developed to aid in the exercising of the abdominal muscles. These work by exercising a muscle against an opposing weight, a spring or resilient band. For example, U.S. Pat. No. 3,532,340, issued to Vincent Naradiello discloses a hula hoop type of ring with springs which the user uses exercising the abdominal muscles by holding the ring with hands and rotating the lower body against the force of springs using abdominal muscles. U.S. Pat. No 4,775,148, issued to Gary G. McLaughlin discloses a spring and belt combination by which the user can exert the abdominal muscles against the resistive force of a spring. U.S. Pat. No. 4,824,105 issued to Zinovy Goldenberg discloses an inflatable bag that is used for exercising muscles. U.S. Pat. No 5,401,228, issued to Gary G. McLaughlin discloses a shell with weight attached to the waist by belt. The abdominal muscles are exercised by exerting them against the resistive force of the weight.

The devices described above allow exercising to be focused on the abdominal muscles. These, however, never provide massage of certain areas of the user's belly by vibrating abdominal muscles without interruption to the exercising of the abdominal muscles. In addition, these devices do not attract the user's attention to lack of muscle contraction, and therefore encourage the performance of the abdominal muscles exercises. Also they can not be used while walking or freely standing.

A various array of devices is known to provide a massage of the user's body. For example, U.S. Pat. No 5,018,511, issued to Yokoy Yasuna discloses a portable massage unit having several massage protrusions for massaging the user's body. However, this device does not allow to alternate massage with strengthening automatically.

No known device for use in exercising the abdominal muscles provides the ease of use and capability for stimulating (encouraging) a contraction of abdominal muscles.

As can be seen from the above discussion there is a need for a simple apparatus that allows the user to easily exercise abdominal muscles without breaking down usual daily activity.

It is also an objective of this invention to attract the user's attention to the exercising of abdominal muscles, by reproducing an exercise command or musical note, serving to indicate to the user to contract muscles, and stop the command, therefore resulting in more efficient development of the abdominal muscles.

It is also an objective of this invention to allow for adjustment to suit the body of a particular user, and to provide increased level of strengthening and relaxation of abdominal muscles.

Another objective of this invention is for the apparatus to provide gentle massage to certain areas of the user's belly by vibrating abdominal muscles during relaxation of the muscles between the contractions.

Still another objective of the present invention is to provide a method for conditioning and exercise that is easy to use, and an apparatus that has adjustable elements, is durable and which is relatively inexpensive to produce.

It is also considered that this invention may be used to distend the stomach by increasing abdominal volume, and exercising stomach muscles.

BRIEF DESCRIPTION OF THE SEVERAL VIEWS OF THE DRAWING

Related objectives and advantages of the present invention will become even more apparent by reference to the following figures, and to detailed description in which similar reference characters refer to similar parts.

DETAILED DESCRIPTION OF THE INVENTION

Figure 1A:
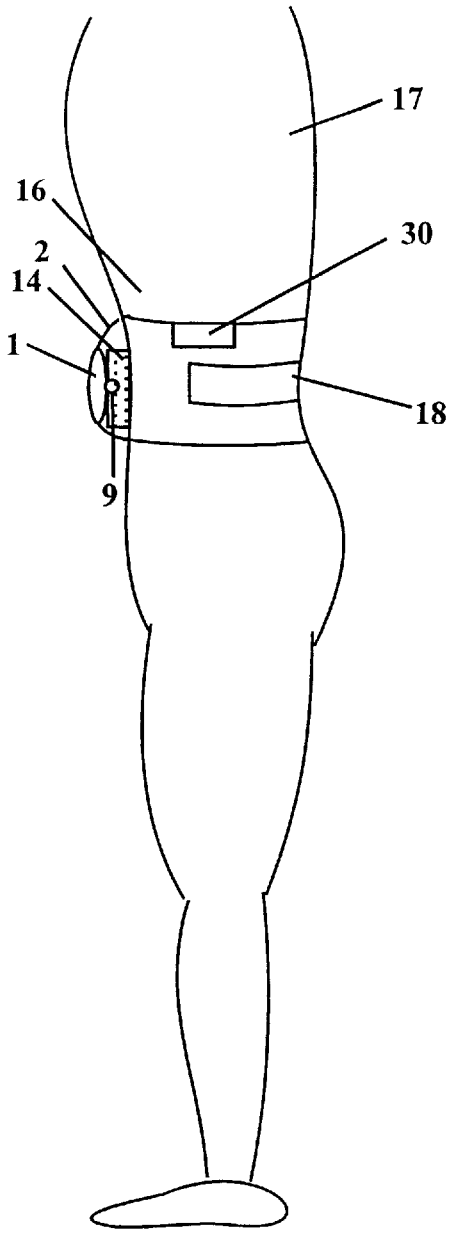
FIGS. 1*a* and 1*b* are perspective views of the device for use in exercising the abdominal muscles, used while standing with contracted and relaxed abdominal muscles, respectively.
Figure 1B:
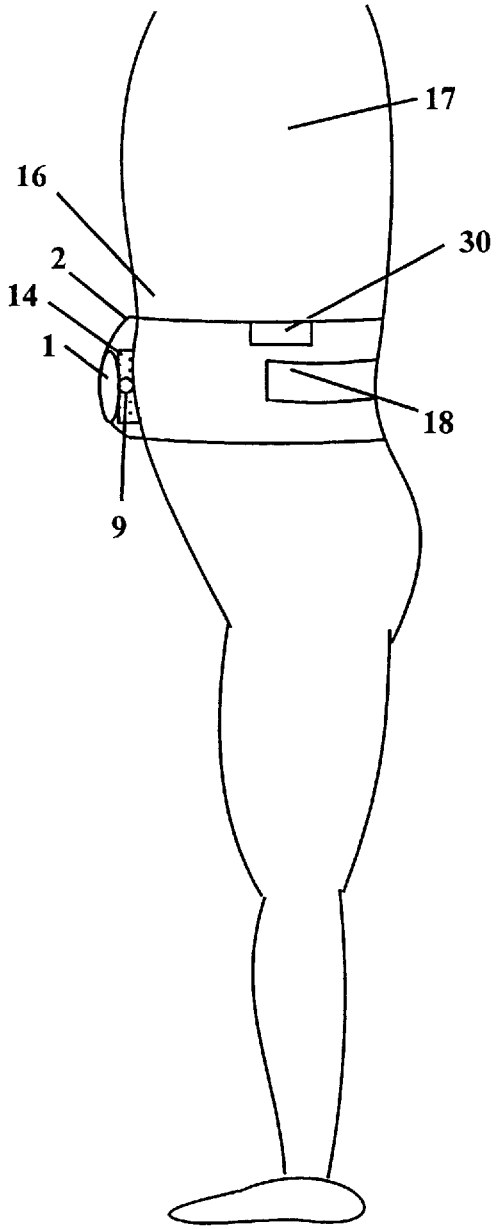
Figure 2:
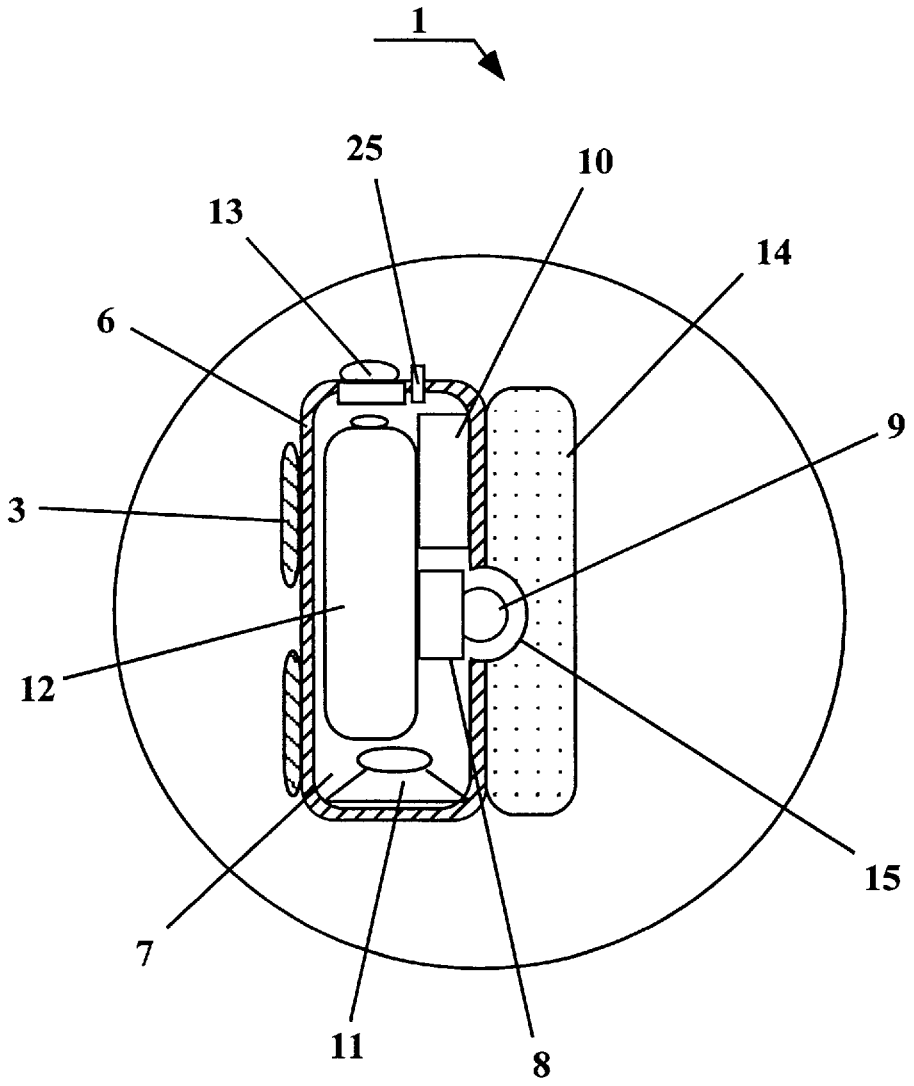
FIG. 2 is an exploded view of the informing unit.

FIGS. 1*a* and 1*b* show the device for exercising the abdominal muscles according to the preferred embodiment of the invention, while the explored view of the informing unit 1 is illustrated in FIG. 2. The apparatus comprises an informing unit 1 and a supporting unit 2 connected by adjustable anchoring elements 3.

Figure 3:
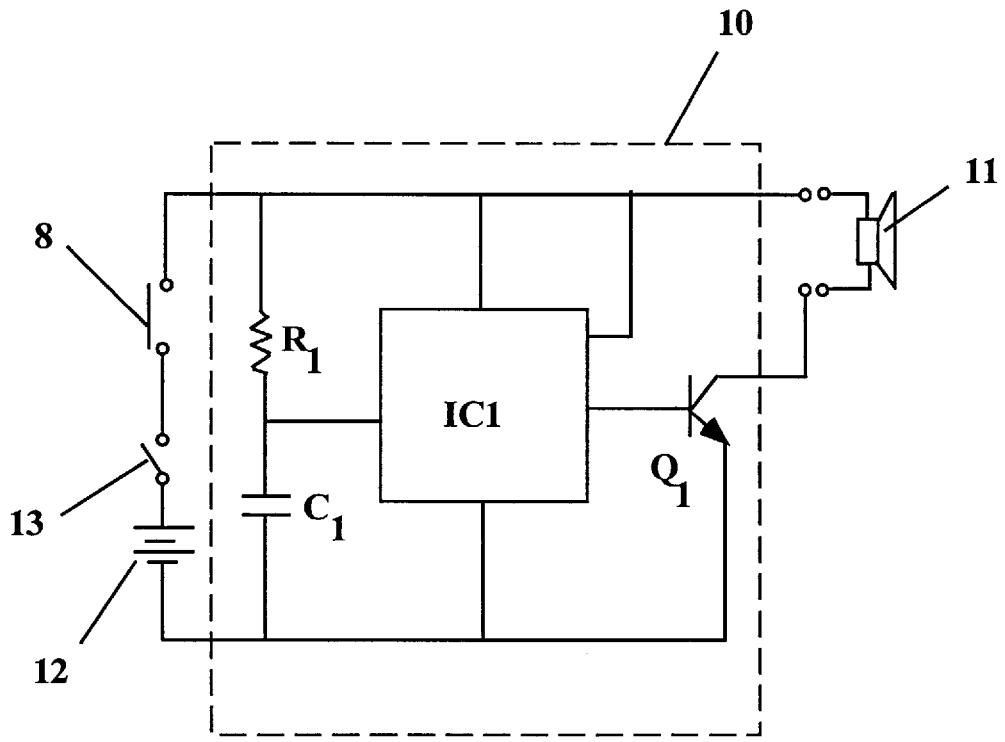
FIG. 3 is a schematic of the informing unit.

The informing unit 1 is composed of a box 6 having a space 7 intended to house a plurality of a sensor 8, with a button 9, a signal-controlling circuit board 10, an announciator 11, a battery 12, and a switch 13. The receiving space 7 is protected by a cap 4 (not shown). The informing unit 1 is designed as a flat element with oval edges helping to avoid inconvenience of use. The informing unit 1 is united with a soft, spring element 14 having a refinement 15 in the part connected to the button 9 of the sensor 8. Preferably a spring element 14 may be developed from foam material and has small stiffness that protects the switch against effects related for example to breathing. When the informing unit 1 is designed to reproduce audio information, the circuitry of the signal-controlling circuit board 10, as shown in FIG. 3, is provided with an integrated circuit (IC1) capable of storing programmable exercise commands or musical notes. The stored commands or musical tunes are reproduced through the speaker 11 in cooperation with a resistor ($R_1$), a capacitor ($C_1$), and a transistor ($Q_1$), when switch 13 is turned on and the signal from the sensor 8 is existed. As an illustrative example, a switch may be used as the sensor 8. In this case the existence of the stored command or visual/tactile signal from signal-controlling circuit board 10 will appear while the switch 13 is permanently turned on and when the switch 8 is turned on by pressing on the bottom 9 of the switch by relaxed abdominal muscles 16 of a user 17.

Figure 4:
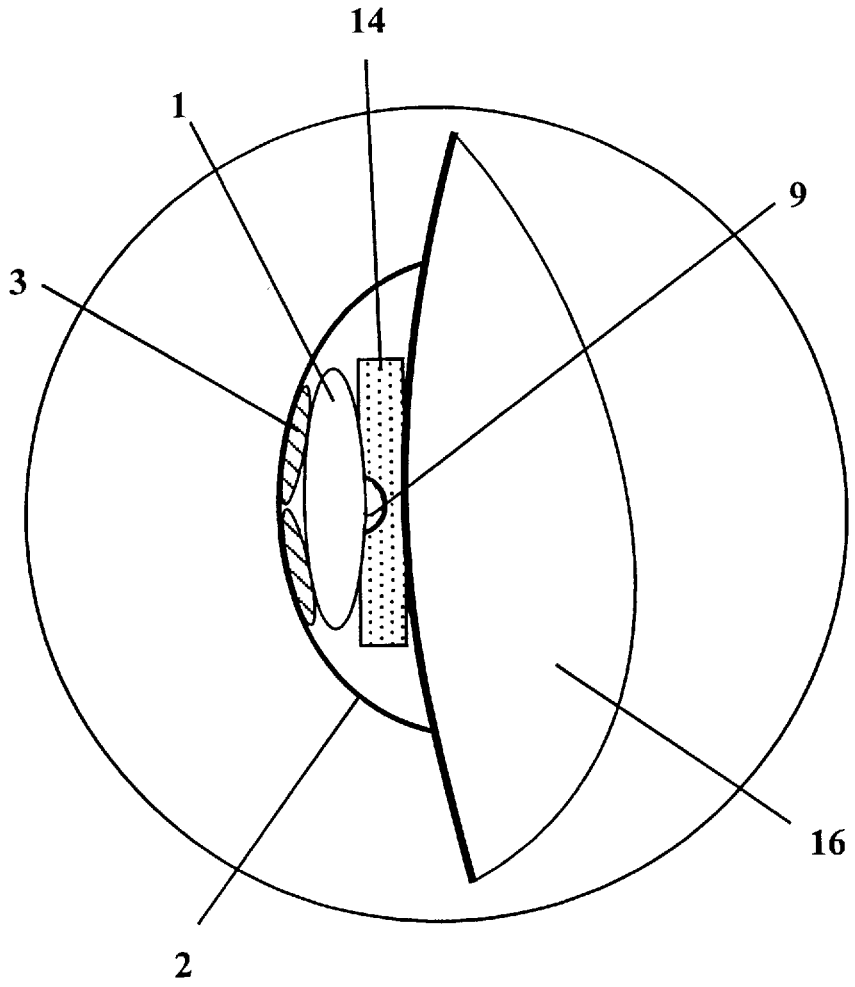
FIG. 4 is an exploded view of the supporting unit with informing unit, view shown from one side.

The supporting unit 2 is provided with anchoring elements 3 to enable correct positioning, and retaining and adjusting the informing unit 1 on the supporting unit 2 (FIG. 4). For example, an adjustment for a proper positioning and retaining the informed unit 1 may be done by adhesive or VELCRO Registered™ hook and loop type material positioned on the informing unit 1 and on the supporting unit 2 (not shown). Also, the anchoring elements 3 may be made of any suitable or desired material. The supporting unit 2 is provided and formed of any suitable flexible and resilient material and can be adjusted to fit the user's waist size. As an illustrative example, the supporting unit 2 may preferably be designed as an elastic or nonelastic belt approximately 3.5 inch wide and may be of any desired adjustable length which will fit both men and women (from 30" to 65"). Also, the supporting unit 2 may be designed as any abdominal supports and may be of any suitable or desired construction and material and may have any suitable closure, or buckle 18 to allow easy installation of the informing unit 1 about the abdomen. This provides also unlimited adjustment of the supporting unit 2 about the user's body 17 when standing, sitting, lying, walking, etc., and when different parts of the user's abdominal muscles are intended to exercise, or when increased level of contraction of the abdominal muscles is necessary to perform.

Figure 5:
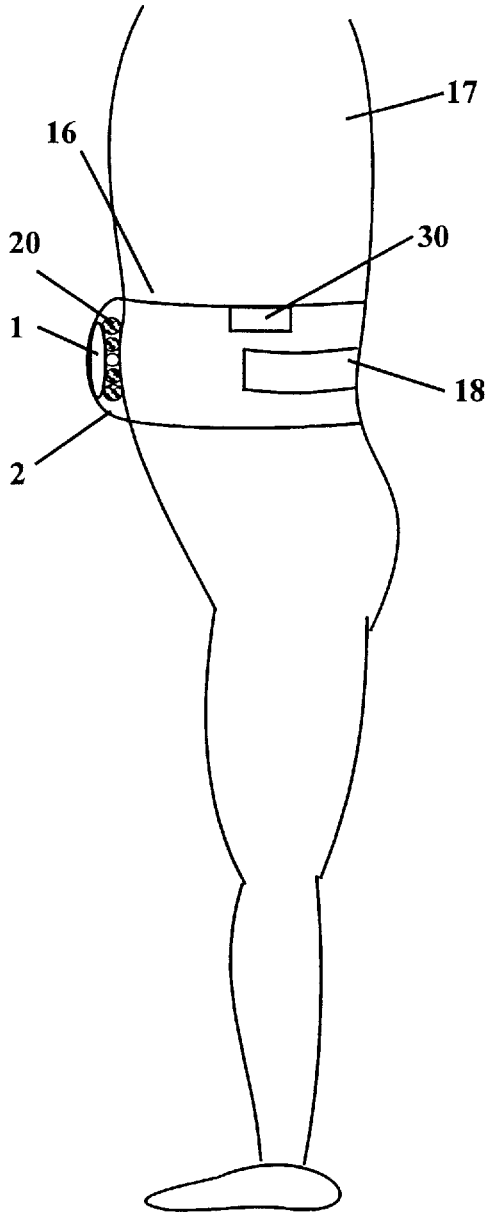
FIG. 5 is a perspective view of the device for use in exercising and massaging of the abdominal muscles, used while standing with relaxed abdominal muscles.
Figure 6:
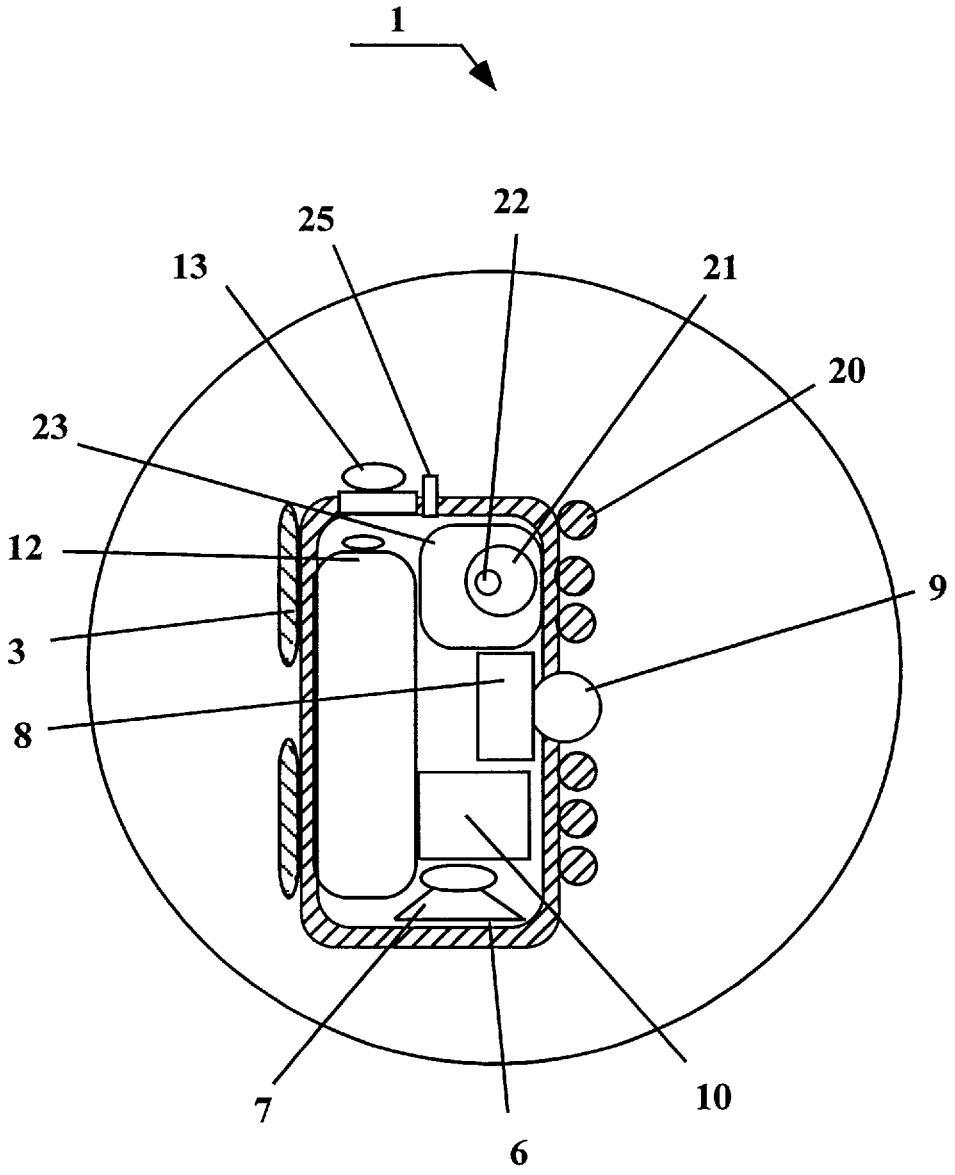
FIG. 6 is an exploded view of the informing unit with the massage element.

For the purpose of providing deeper relaxation of the abdominal muscles between the isometrical contractions, the informing unit 1 is provided with a vibrator 19 (not shown) and several massage protrusions 20 positioned on the side of the box 6 directed to user's abdominal region 16 (FIGS. 5, 6) The vibrator 19 is designed as a load 21 eccentricity mounted to an axis 22 of an electrical motor 23. The informing unit 1 is supplied with the sensor 8 the bottom 9 of which is connected to the user's abdominal muscles 16 and the switch 13 that is on while the apparatus is in working condition. When the abdominal muscles 16 are isometrically contracted, there is no signal from the sensor 8 and there are no vibration. When the abdominal muscles 16 are relaxed, the sensor 8 is on and the vibrator 19 provide gentle massage through the box 6 and massage protrusions 20 to the abdominal muscles 16 of the user 17. As an example the sensor 8 may be developed as a switch having a lever (not shown). When the switch 8 is on the lever is located between the protrusions 20. This permits a contact of the protrusions 20 with the abdominal muscles 16. The range of displacement of the bottom 9 is from 0.5" to ¾" which allows to operate the massager 19. The informing unit 1 having attaching elements 3 on the opposite side to the massage protrusions 20, therefore enabling positioning and retaining the unit 1 on the supporting unit 2.

As an illustrative example, the informing unit 1 while combined both, informing and massaging applications may preferably be designed as a flat oval box approximately 1 inch in thickness, 3 inch long and 2 inch wide, which fits both men and women. Also, the unit 1 may be of any suitable or desired construction and material, and may contain of any suitable or desired elements to allow easy installation about the abdomen and unlimited adjustment for massaging of different regions of the user's belly.

Figure 7:
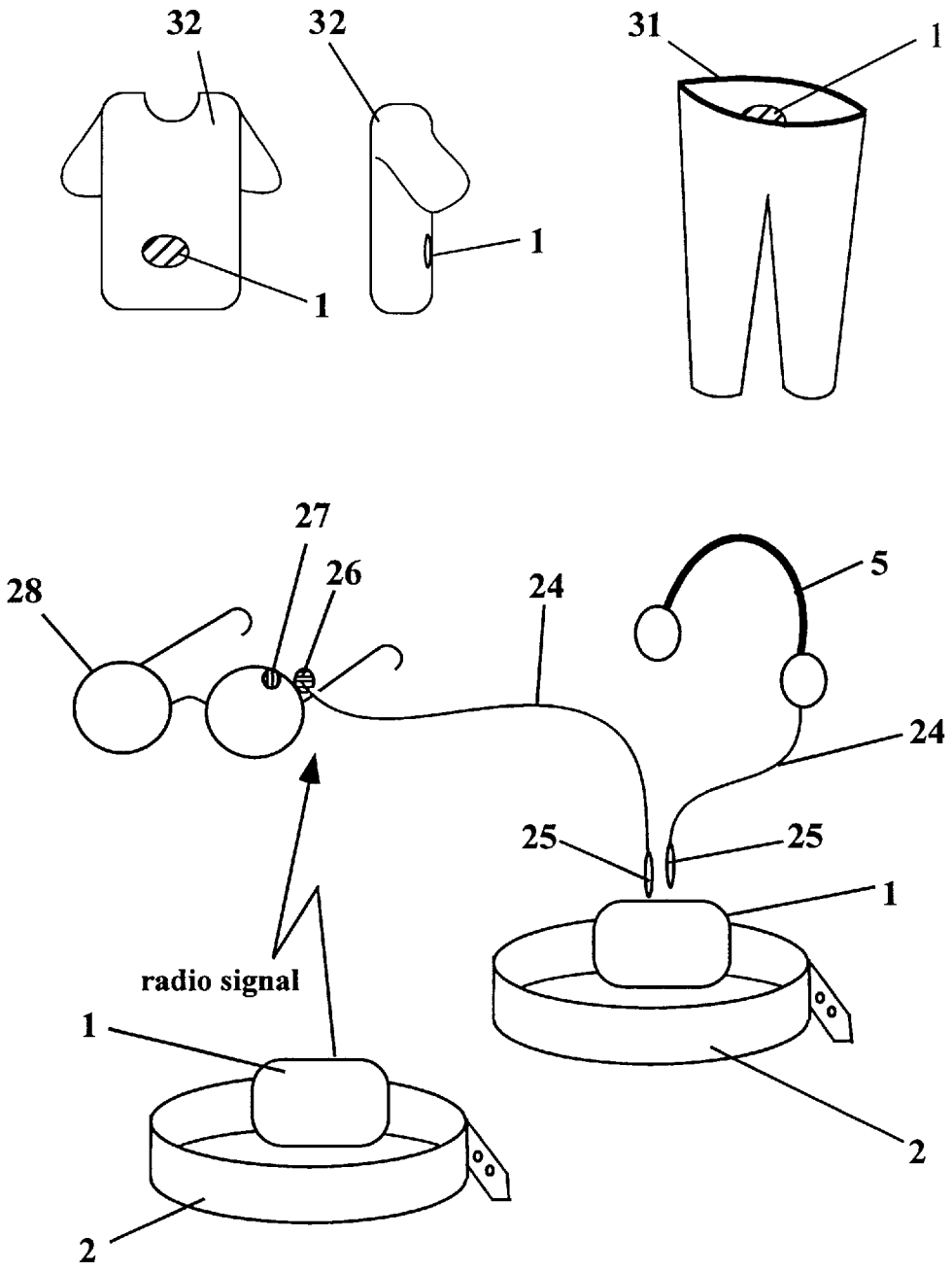
FIG. 7 is a perspective view of the variants of positioning of the apparatus and the variants of positioning of the announciator for use in exercising of the abdominal muscles.

While the above description contains many specifics, the reader should not construe these as limitations on the scope of the invention, but merely as exemplifications of preferred embodiments thereof. Those skilled in the art will envisage many other possible variations that are within the invention scope. For example, the informing unit 1 may be installed about the abdomen 16 of the user 17 with a regular belt 31 (which uses closures), may be positioned on the internal part of the user's T-short 32, or may be installed any other way (FIG. 7). Also, the signalizing unit 1 may preferably be supplied with any types of announciators such as a buzzer, a regular earphone positioned on the use's ear, headphones 5, and connected by wires 24 to the connector 25 (FIG. 8). It also possible to control the announciator by radio signals. This will make the use of the device absolutely imperceptible by other people. The use of a small electrical bulb 26 or light-emitted diode 27 positioned on the user's glasses frame 28 and controlled by radio 29 will make it easy to use by those who have a hearing problem. For the purpose of facilitating the use of the apparatus and providing reliable information to encourage the user to exercise the abdominal muscles, the signalizing unit 1 may be supplied with a small vibrator 30 connected to any part of the user's body. The vibrator 30 also may be positioned on the abdominal support 2. A regular portable radio set, or a cassette player can be used as the announciator. In this case the sensor 8 will activate the radio set or cassette player reproducing music, an exercise command, or musical note, serving to indicate to the user to contract muscles, and stop the command, therefore resulting in more efficient development of the abdominal muscles.

It is further understood that any location of the informing unit 1 with the sensor 8 along the supporting unit 2 is possible, as well as any other positioning of the sensor 8 on the user's body in combination with the supporting unit 2 or without it are possible. It is also further understood that time delay between the start of contracting of the abdominal muscles (activation of the sensor) and the signal from the announciator can be adjusted by the user. This provides special information and attracts the user's attention to the particular muscle group to be exercised. It is also further understood that the signalizing unit 1 may be of any suitable or desired construction and material and may have any suitable or desired elements to allow easy installation about any part of the user's body and provide unlimited adjustment for the particular needs of the user.

The apparatus may be supplied with an electrical stimulator which delivers single, repetitive, twin, etc., pulses to abdominal muscles 16 providing activation of these muscles. The activation of the electrical stimulator is provided by the sensor 8 when the abdominal muscles 16 are relaxed. After being stimulated, the abdominal muscles become contracted, deactivating the sensor 8, which will stop electrostimulation of abdominal muscles.

To use the apparatus, a user should first install the informing unit 1 on the supporting unit 2 using anchoring elements 3. Then the supporting unit 2, or abdominal support, or belt with informing unit 1 should be installed about the user's abdomen 16 using buckle 18 to provide positioning of the informing unit on the belly. As an example we describe the operation of the invention when the switch is used as the sensor 8. The relaxed position of the user's belly will produce a contact of the abdomen 16 with the spring element 14 resulting a pressure on the button 9 of the switch 8. This will turn the switch 8 on, activating the signalizing unit 1 and producing a sound, visual, tactile or other signal depending on the particular structure of the apparatus. In response the user should contract the abdominal muscles 16 to draw the belly in which will release the pressure on the bottom 9 of the switch 8. This will turn off the switch 8 stopping the production of any audio/visual or tactile information. This will inform the user about the desired goal. By changing for example the length of the abdominal support 2 and position of the signalizing unit 1 on the abdominal support 2, the user will adjust the apparatus to his/her particular exercise protocol. When the adjustment is done, the contraction of the user's abdominal muscles 16, directed to draw the belly in will terminate any audio/visual or tactile signals from the informing unit 1. When the user relaxes the abdominal muscles, the belly will change shape, thereby pressing on the bottom 9 of the switch 8 that will emit a signal from the informing unit 1, encouraging the user to contract the abdominal muscles to avoid the sound or visual/tactile information.

If the signal from the signalizing unit 1 is present all the time, even when the abdominal muscles 16 are isometrically contracted, the length of the abdominal support 2 should be increased giving more space between the bottom 9 of the switch 8 and belly of the user. When there is not signal from the informing unit 1 while the abdominal muscles 16 are completely relaxed, the length of the abdominal support 2 should be decreased. Since the position of the sensor is adjusted, the user may exercise the abdominal muscles contracting them for appropriate time. The information receiving from pressing of the bottom 9 of the switch 8 will stimulate the user to contract the abdominal muscles. Similar procedure of adjusting the device is used while the user wants to increase the level of contraction of the abdominal muscles depending on his/her abilities achieved as a result of the previous exercises.

To provide the increased relaxation of the abdominal muscles between the isometrical contractions, the apparatus of the present invention includes the massager 19 that provides gentle massage of certain areas of the user's belly by vibrating the muscles 16 between the contractions. For example, while the switch 13 is on the massager 19 (not shown) is operated by the switch 8. When the user 17 relaxes the abdominal muscles, the belly will change a shape and press on the bottom 9 of the switch 8 which will turn on the motor 23 providing a vibration of the box 6. The vibration of the box 6 will be applied to the user's belly through the massage protrusions 20. When the process of relaxation is completed, the user will contract his/her abdominal muscles 16, which will stop the massage application. It is also understood that the massage unit may be also used as an element of tactile information encouraging the user 17 to contract the abdominal muscles 16. Also, the unit 1 may be positioned and retained on any place on the supporting unit 2 providing massage of different parts of the user's belly.

The described apparatus may also be used to control the level of increasing of an abdominal volume. This results from the distending of the stomach by exercising of stomach muscles. This procedure is important for patients recovering from stomach surgery. To use the apparatus for increasing abdominal volume, a user 17 first should loosely install the abdominal support 2 with the informing unit 1 about his/her abdomen using buckle 18. The relaxed position of the user's belly will not produce a contact of the abdomen with the bottom 9 of the switch 8. This will not activate the signalizing unit 1 and will not produce any sound or visual, or tactile signal. Then the user should distend of a stomach increasing of an abdominal volume. This will make a pressure on the button 9 activating the signalizing unit 1 and producing audio/visual or tactile information to the user about the achieved result. The user will be encouraged to perform exercises which increase the abdominal volume based on the audio, visual or tactile information from the apparatus.

The position of the informing unit 1 with the switch may be different depending on the desired region of a belly to be exercised. For example, if the user wants to exercise lower abdominal muscles, the informing unit 1 should be positioned on the lower part of the abdominal support 2. If the user is interested in exercising left or right side of the belly, the informing unit 1 should be positioned on the corresponding side of the abdominal support 2.

The described apparatus and method can be used to exercise the abdominal muscles during everyday activity of the user including walking, standing, sitting, etc.

The present invention is a fun apparatus to exercise with, because it is provided with a sound-reproducing means capable of reproducing an exercise command or a musical tune, which is programmed into an integrated circuit.

Accordingly, the scope of the invention should be determined not by embodiment illustrated, but by the appended claims and their legal equivalents.

What we claim is:

1. A method for exercising the abdominal muscles comprising the steps of:

providing a device comprised of:

* an informing unit having a sensor activated depending on the position of the user's belly, an announciator, a switch, a battery, and a massager having several massage protrusions on one side for massaging the abdominal muscles of the user, and elements to retain said informing unit on an abdominal support;

* the abdominal support for providing a gentle pressure over a wide area of the belly of a user, and having elements to enable positioning and retaining the informing unit with the massager on the side directed to the user's belly;

placing the working informing unit on the abdominal support;

placing the abdominal support around the back of the user to retain the informing unit in place on the user's abdomen in relaxed position providing an activation of the sensor which will provide a massage application;

locking the abdominal support over the waist of the user in position when the sensor is active and there is a massage application;

drawing the belly in by contracting of the abdominal muscles releasing the activation of the sensor which will terminate the massage application;

conversely, relaxing the abdominal muscles which will activate the sensor and produce the massage of the user's abdominal muscles;

turning off the switch when the exercise session is finished.

2. A method for exercising the abdominal muscles as recited in claim 1 where the informing unit with the sensor and the massager is positioned either to the left or right of the belly, or to lower or higher areas of the belly encouraging the user to exercise different parts of the abdominal muscles and massaging of these muscles when they are relaxed resulting in more efficient development of these muscles.

3. A method for exercising the abdominal muscles as recited in claim 1 where the sensor is designed as a switch.

4. A method for exercising the abdominal muscles as recited in claim 1 where the abdominal support is provided by a belt of trousers, shorts, skirt or by a regular shirt.

5. A method for exercising the abdominal muscles as recited in claim 1 where the informing unit with the sensor and the massager is taped to the user's belly.

6. A method for exercising the abdominal muscles as recited in claim 1 where the apparatus comprised of at least two informing units positioned on different parts of the user's belly and operated by the sensors independently.

* * * * *